United States Patent [19]

Schaeper et al.

[11] Patent Number: 4,460,149

[45] **Date of Patent: * Jul. 17, 1984**

[54] ANNULAR BLOWOUT PREVENTER WITH UPPER AND LOWER SPHERICAL SEALING SURFACES

[75] Inventors: Gary R. Schaeper; Richard A. Olson, both of Houston, Tex.

[73] Assignee: NL Industries, Inc., New York, N.Y.

[ * ] Notice: The portion of the term of this patent subsequent to Aug. 11, 1998 has been disclaimed.

[21] Appl. No.: 275,280

[22] Filed: Jun. 19, 1981

Related U.S. Application Data

[63] Continuation of Ser. No. 156,833, Jun. 5, 1980, Pat. No. 4,283,039.

[51] Int. Cl.[3] ..... E21B 33/06

[52] U.S. Cl. ..... 251/1 B; 277/31; 277/188 A; 277/235 R

[58] Field of Search ..... 166/84; 251/1 B, 1 R; 277/31, 38, 103, 188 A, 235 R, 188 R

[56] References Cited

U.S. PATENT DOCUMENTS

| | | | |
|---|---|---|---|
| 2,164,857 | 7/1939 | MacClatchie | 277/31 |
| 2,846,178 | 8/1958 | Minor | 251/1 B |
| 3,323,773 | 6/1967 | Walker | 277/73 |
| 3,561,723 | 2/1971 | Cugini | 251/1 B |
| 3,572,628 | 3/1971 | Jones | 251/1 B |
| 3,626,505 | 12/1971 | Douglas | 277/2 |
| 3,631,767 | 1/1972 | Meier | 277/188 R |
| 3,667,721 | 6/1972 | Vujasinovic | 251/1 B |
| 4,099,699 | 7/1978 | Allen | 251/1 B |
| 4,283,039 | 8/1981 | Schaeper et al. | 251/1 B |

FOREIGN PATENT DOCUMENTS

| | | | |
|---|---|---|---|
| 477457 | 12/1937 | United Kingdom | 277/31 |

*Primary Examiner*—Martin P. Schwadron
*Assistant Examiner*—Sheri Novack
*Attorney, Agent, or Firm*—Browning, Bushman, Zamecki & Anderson

[57] ABSTRACT

An annular blowout preventer for use on an oil or gas well rig having a lower housing, an upper housing, a resilient sealing means, a vertical bore coaxially positioned through the housing and a vertically acting piston for actuating the sealing means in which the inner surface of the upper housing and the inner surface of the lower housing are concentric spherical surfaces extending to the bore. The resilient sealing means includes steel segments extending between the top and bottom of the sealing means and the top and bottom of the sealing means and the steel segments have spherical surfaces coacting with the spherical surfaces on the upper and lower housings. The upper and lower housings each include a vertical wall extending downwardly from the spherical surfaces on the upper and lower housing and the vertical moving piston sealingly engages the vertical walls.

14 Claims, 6 Drawing Figures

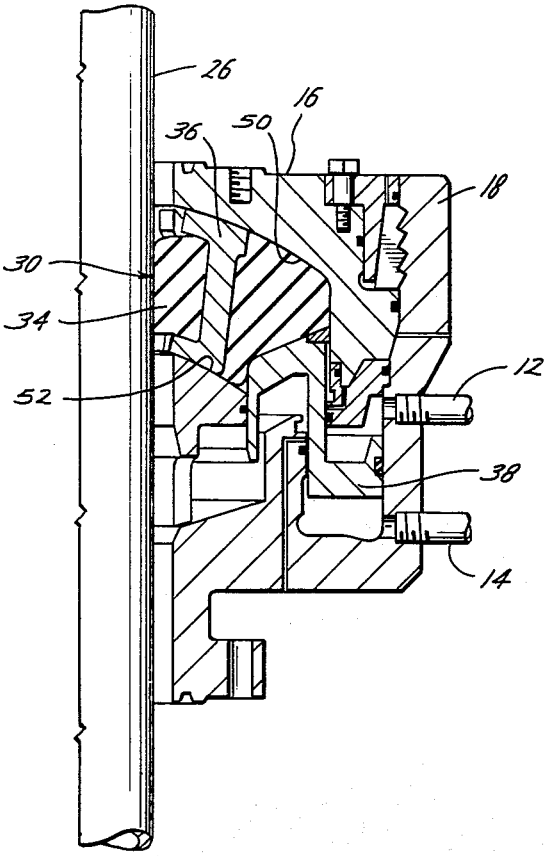
Fig. 4
Fig. 5
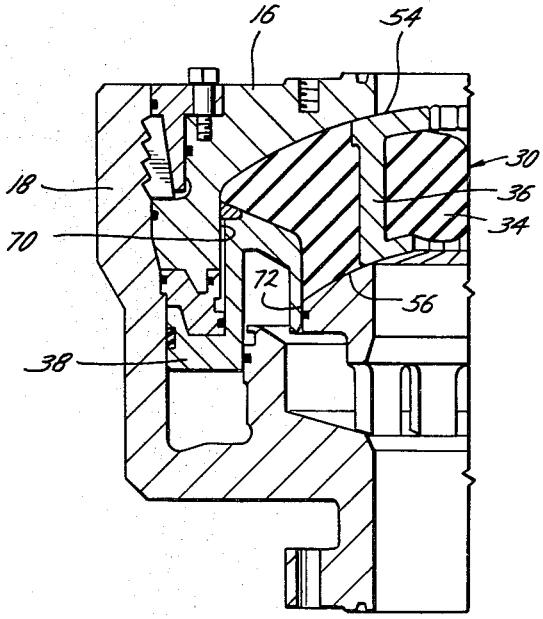
Fig. 6
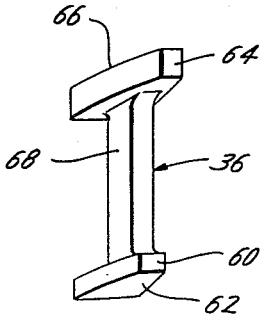

ANNULAR BLOWOUT PREVENTER WITH UPPER AND LOWER SPHERICAL SEALING SURFACES

This is a continuation of application Ser. No. 156,833, filed June 5, 1980, now U.S. Pat. No. 4,283,039.

BACKGROUND OF THE INVENTION

U.S. Pat. No. 3,667,721 generally describes an annular blowout preventer for closing and sealing on an open hole, a casing, drill pipe, tubing, or kelly in which the inner surface of the upper housing is a spherical surface.

The present invention is directed to an improved annular blowout preventer in which the overall height is shorter, the hydraulic volume required to actuate the preventer is reduced by at least 50% thereby reducing the size of the required hydraulic actuating system, the closing time of the blowout preventer is reduced by about 50%, and the cost of the blowout preventer is substantially reduced.

SUMMARY

The present invention is directed to an improved blowout preventer adapted for use in an oil or gas well rig having a lower housing, an upper housing, a resilient sealing means positioned between the housings, and piston means for actuating the sealing means in which the inner surface of the upper housing has a spherical surface, the inner surface of the lower housing has a spherical surface, and the resilient sealing means includes upper and lower spherical surfaces for coacting with the spherical surfaces on the upper housing and lower housing, respectively.

Another object of the present invention is the provision of a blowout preventer in which the spherical surfaces of the upper housing and the lower housing are concentric.

Still a further object of the present invention is the provision of sealing means including steel segments extending between the top and bottom of the sealing means in which the top and bottom of the steel segments have spherical surfaces.

Yet a still further object is the provision of a blowout preventer having a lower housing, an upper housing, a resilient sealing means positioned between the housings, a vertical bore coaxially positioned through the housing, and a vertically acting piston for actuating the sealing means in which the inner surface of the upper housing has a spherical surface extending to the bore, and the inner surface of the lower housing has a spherical surface extending to the bore, and the spherical surfaces are concentric. The sealing means includes steel segments extending between the top and bottom of the sealing means and the top and bottom of the sealing means and of the steel segments are concentric spherical surfaces coacting with the spherical surfaces on the upper and lower housings. The upper and lower housings each includes a vertical wall extending downwardly from the spherical surfaces on the upper and lower housings, and the vertically moving piston sealingly engages the vertical walls.

Other and further objects, features and advantages will be apparent from the following description of a presently preferred embodiment of the invention, given for the purpose of disclosure, and taken in conjunction with the accompanying drawings where like character references designate like parts throughout the several views.

BRIEF DESCRIPTION OF THE DRAWINGS

FIG. 4 is a fragmentary elevational view, in cross section, illustrating the blowout preventer of the present invention in the closed position around the drilling string, FIG. 5 is a fragmentary elevational view, in cross section, illustrating the blowout preventer of the present invention in a closed position in the open bore, and FIG. 6 is an enlarged perspective view of the metallic translating segments of the sealing element.

DESCRIPTION OF THE PREFERRED EMBODIMENT

Figure 1:
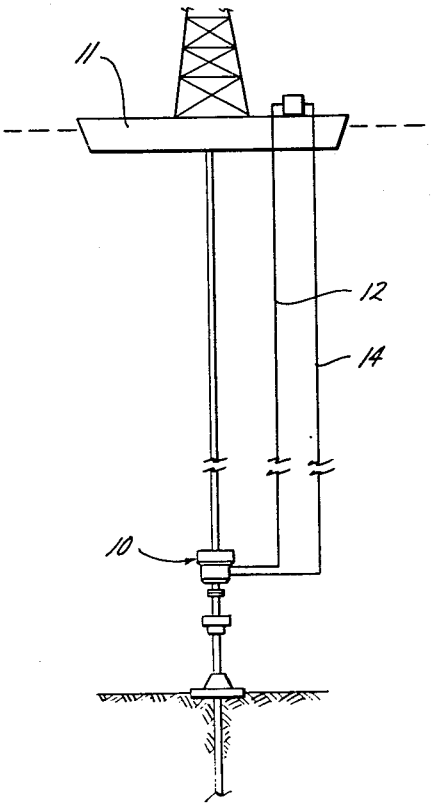
FIG. 1 is a diagrammatic view of a subsea drilling rig in which the blowout preventer of the present invention may be used.
Figure 3:
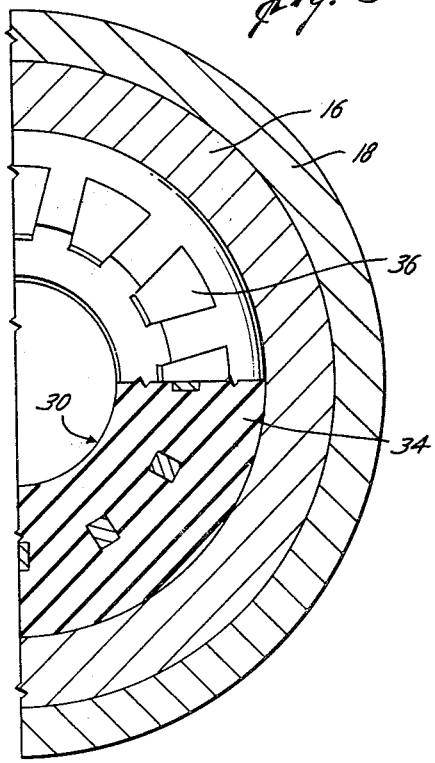
FIG. 3 is a fragmentary elevational view, partly in cross section, taken along the line 3—3 of FIG. 2.

The blowout preventer of the present invention is generally indicated by the reference numeral 10 and as shown in FIG. 1, for example only, as used in an offshore subsea drilling operation in which the blowout preventer 10 is actuated from a floating drilling rig 11 by control lines 12 and 14. However, the present apparatus 10 may be used on all types of drilling rigs whether they are underwater or not.

Figure 2:
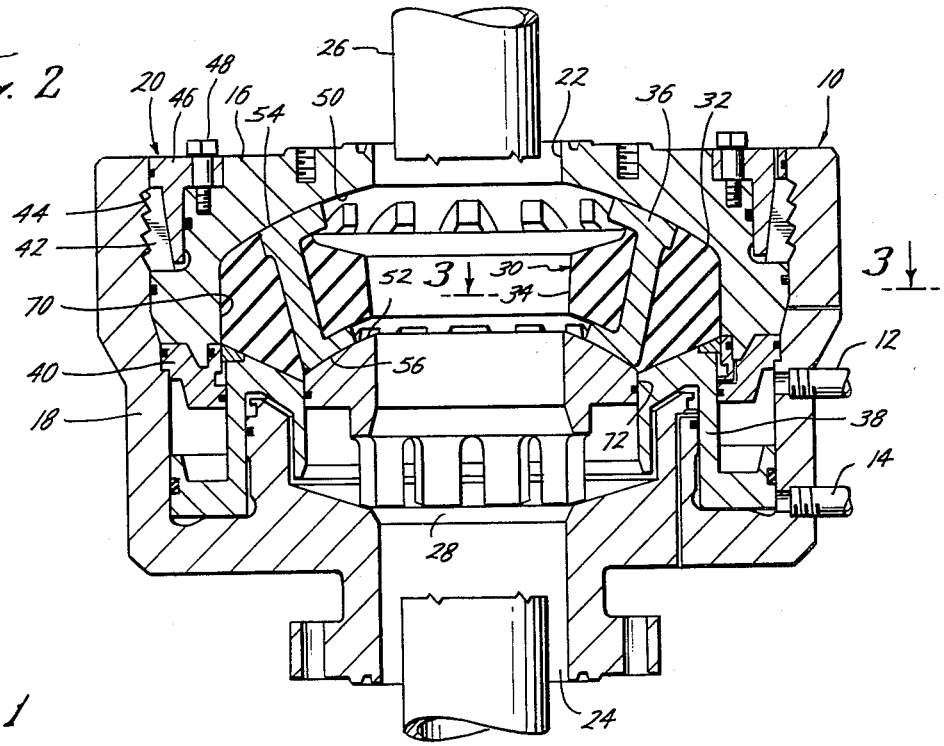
FIG. 2 is an elevational view in cross section of the preferred embodiment of the present invention in the open and non-sealing position with a drilling string within the apparatus.

The blowout preventer 10, as best seen in FIG. 2, may include an upper housing 16, and a lower housing 18, which are releasably secured together by a locking mechanism generally indicated by the reference numeral 20.

Axially aligned well tool receiving ports 22 and 24 are provided in the upper housing 16 and the lower housing 18, respectively, for receiving a well tool or drilling string 26 adapted to be axially moved within a coaxial bore 28 in the housings 16 and 18.

The sealing element generally indicated by the reference numeral 30 includes a resilient sealing means 32 positioned between the upper housing 16 and the lower housing 18 and is adapted to be selectively moved between a non-sealing position, as shown in FIG. 2, to a sealing position, as shown in FIGS. 4 and 5. The sealing means 32 may include a continuous ring of resilient material such as natural or synthetic rubber. The seal 32 includes an inner bore 34 approximately equal to the diameter of the housing bore 28.

The sealing element 30 also includes a plurality of radially spaced translating means or steel segments 36 which are provided for slideably cooperating with the upper housing 16 and the lower housing 18 for converting vertical movement of an actuating means such as piston 38 into an inward motion of the sealing means 30 to provide a seal in the housing bore 28. Preferably, the radially spaced steel segments 36 are bonded to the resilient sealing ring 32. The actuating means or piston 38 is double acting and is moved vertically by fluid control lines 12 and 14.

While any suitable locking means may be utilized to secure the upper housing 16 to the lower housing 18 and seat the upper housing 16 on an adapter ring 40, the locking means may include an outer latch ring 42 having angled teeth which coact with a locking groove 44 in the lower housing 18, a locking ring 46 having a tapered surface which engages the tapered back surface of the latch ring 42 and bolts 48 for securing the locking ring to the upper body 16.

The inner surface 50 of the upper housing 16 includes a spherical surface which extends to the bore 28. In addition, the inner surface 52 of the upper housing 18 includes a spherical surface 52 which extends to the bore 28. The spherical surfaces 50 and 52 are concentric and serve to guide and control the path of movement of the sealing element 30.

In addition, the sealing means 30 include an upper surface 54 in which both the resilient sealing means 34 and the steel segments 36 have a spherical surface which conform to and coact with the spherical surface 50 of the upper housing 16. Similarly, the sealing means 30 including the resilient sealing means 32 and the steel segments 36 have a lower surface 56 which is spherical and coacts with the lower spherical surface 52 on the lower housing 18.

The metallic translating means or steel segments 36 as best seen in FIGS. 2–6, generally include a base 60 having a curved spherical surface 62 mating with spherical surface 52 and a top 64 having a curved spherical surface 66 which coacts with the spherical surface 50. The base 60 and top 64 are joined by a web 68. The surfaces 62 and 66 coact with the surfaces 52 and 50 to provide a low friction, metal-to-metal sliding surface during the inward closing action of the sealing element 30 to smoothly guide the sealing element 30 between the spherical surfaces 50 and 52.

The inner surface of the upper housing 16 also includes a vertical wall 70 extending downwardly from the spherical surface 50. The inner surface of the lower housing 16 also includes a vertical wall 72 extending downwardly from the spherical surface 52. The vertically moving piston 38 sealingly engages the vertical walls 70 and 72 and moves from the contracted position shown in FIG. 2 to the set position shown in FIGS. 4 and 5 into the space between the spherical surfaces 50 and 52. It is to be noted that the spherical surfaces 50 and 52 control and restrict the movement of the sealing element 30 to more positively control the movement and sealing action as the piston 38 moves upwardly as best seen in FIGS. 4 and 5. In addition, the structure of the present invention reduces the overall height of the blowout preventer 10, reduces the hydraulic volume required to close the blowout preventer 10 by at least 50% thereby decreasing the size of the controlling hydraulic system, and decreases the closing time by about 50% as well as providing a blowout preventer which costs substantially less. After initial sealing is achieved, pressure acting on the underside of the piston 38 aids in maintaining the blowout preventer in the sealed position. Opening of the preventer 10 is achieved by moving the piston 38 downwardly towards its initial position and the elastic characteristics of the sealing means 32 causes it to move outwardly between its containing two spherical surfaces 50 and 52 to the open position.

The present invention, therefore, is well adapted to carry out the objects and attain the ends and advantages mentioned as well as others inherent therein. While a presently preferred embodiment of the invention is given for the purpose of disclosure, numerous changes in the details of construction and arrangement of parts may be made which will readily suggest themselves to those skilled in the art and which are encompassed within the spirit of the invention and the scope of the appended claims.

What is claimed is:

1. A blowout preventer comprising:

housing means defining an internal longitudinal bore, the centerline of said bore defining a longitudinal direction with respect to said blowout preventer;

means in said housing defining generally longitudinally facing opposed upper and lower guide surfaces, said guide surfaces being longitudinally and radially inclined generally parallel to each other;

seal means disposed generally between said guide surfaces, said seal means comprising— an annular elastomeric body partially defining said bore, and a plurality of circumferentially spaced rigid translation elements extending generally longitudinally through said elastomeric body, each of said translation elements having an upper end face slidably movable along said upper guide surface and a lower end face slidably movable along said lower guide surface; and longitudinally movable actuator means for radially extending and retracting said seal means to restrict and open said bore such radial extension and retraction including simultaneous sliding movement of said upper and lower end faces along said upper and lower guide surfaces respectively.

2. A blowout preventer according to claim 1 wherein said upper and lower end faces of said translation elements are inclined parallel to said guide surfaces.

3. A blowout preventer according to claim 2 wherein each of said translation elements comprises an upper base defining said upper end face, a lower base defining said lower end face, and a web portion interconnecting said upper and lower bases.

4. A blowout preventer according to claim 3 wherein said web portion is smaller than said bases in both radial and circumferential extent.

5. A blowout preventer according to claim 4 wherein said bases are wedge-shaped with their wide ends disposed radially outermost in said elastomeric body.

6. A blowout preventer according to claim 2 wherein said guide surfaces and said end faces are spherical and concentric.

7. A blowout preventer according to claim 6 wherein said housing means comprises upper and lower housing parts each defining a respective one of said guide surfaces.

8. A blowout preventer according to claim 1 wherein said elastomeric body comprises a continuous annulus; said means defining each of said guide surfaces are, respectively, integral; and each of said guide surfaces is a continuous annular surface.

9. A blowout preventer according to claim 1 wherein said actuator means comprises a longitudinally reciprocable piston having abutment means generally axially abutting said elastomeric body.

10. A blowout preventer according to claim 9 wherein said abutment means is adapted, upon longitudinal extension of said piston, to move into a position radially displacing and circumferentially surrounding at least a portion of said elastomeric body, whereby said body can be displaced radially inwardly without substantial longitudinal displacement.

11. A blowout preventer according to claim 10 said abutment means in said extended position is located longitudinally between said guide surfaces.

12. A blowout preventer according to claim 10 wherein said abutment means includes an abutment surface which, in a retracted position of said piston, is disposed closely adjacent one of said guide surfaces for movement toward the other of said guide surfaces.

13. A blowout preventer according to claim 12 wherein said abutment surface is longitudinally and radially inclined in a direction generally opposite to that of said guide surfaces.

14. A blowout preventer according to claim 9 wherein said piston is double acting.

* * * * *